United States Patent [19]

Lira

[11] 4,155,233

[45] May 22, 1979

[54] DECK LID LOCK SAFETY RELEASE

[75] Inventor: Nicholas Lira, Dayton, Ohio

[73] Assignee: Christopher Ward, Dayton, Ohio ; a part interest

[21] Appl. No.: 837,106

[22] Filed: Sep. 28, 1977

[51] Int. Cl.[2] ..... E05B 65/19; E05C 15/02

[52] U.S. Cl. ..... 70/92; 70/DIG. 42; 292/92; 292/111; 292/DIG. 42

[58] Field of Search ..... 70/DIG. 9, DIG. 12, 70/DIG. 39, DIG. 42, 92; 292/11, 13, 49, 111, 129, 92, DIG. 42; 64/23; 403/113, 117, 335, 336

[56] References Cited

U.S. PATENT DOCUMENTS

| | | | |
|---|---|---|---|
| 2,977,785 | 4/1961 | Beckman | 292/129 X |
| 3,010,749 | 11/1961 | Brissette et al. | 292/129 X |
| 3,062,033 | 11/1962 | Schmalfeldt | 70/DIG. 42 |
| 3,089,330 | 5/1963 | Kerr | 70/DIG. 42 |
| 3,321,226 | 5/1967 | Claire et al. | 292/111 X |
| 3,992,909 | 11/1976 | McGhee | 292/92 X |

*Primary Examiner*—J. Franklin Foss

*Attorney, Agent, or Firm*—Bacon & Thomas

[57] ABSTRACT

An automobile deck or trunk lid having a key operated lock for releasing a lid latch is provided with a lost motion drive connection in a shaft between the lock and latch and the inner end of the shaft has a knob accessible from within the trunk compartment for releasing the latch without turning the key operated lock. The shaft is readily detachable and attachable to the lock and latch so that it may be installed as a replacement for a conventional one-piece shaft in existing automobiles.

1 Claim, 6 Drawing Figures

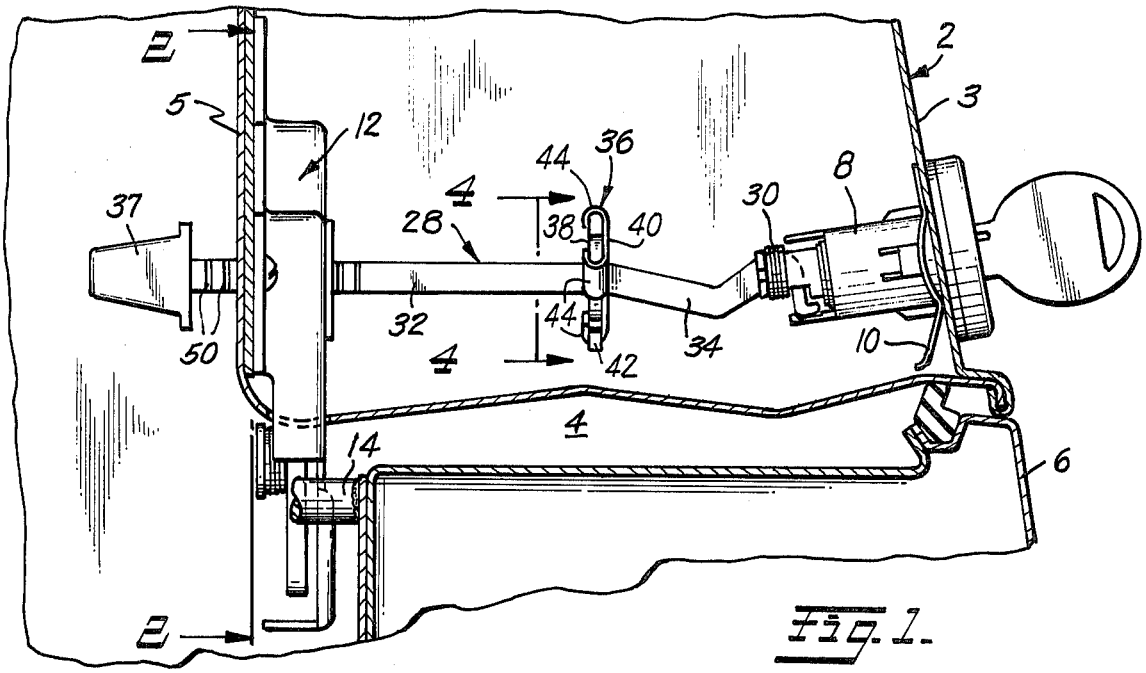
Fig. 1.
Fig. 2.
LOCKED
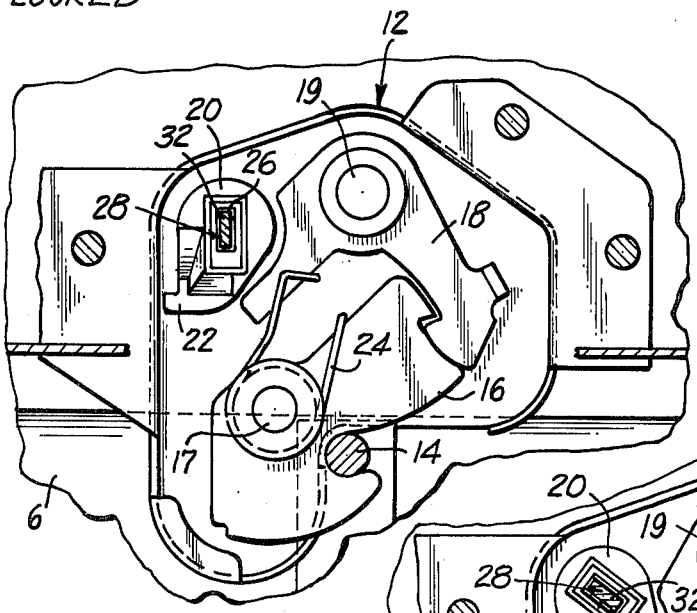
Fig. 3.
UNLOCKED
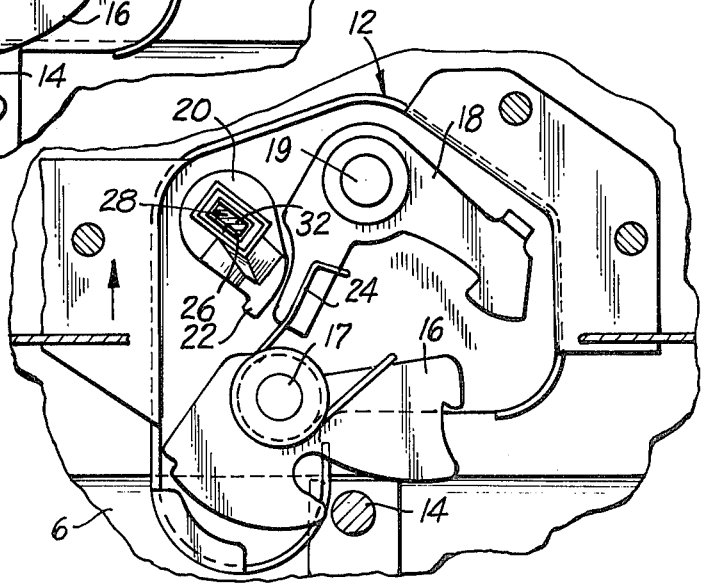

DECK LID LOCK SAFETY RELEASE

BACKGROUND OF THE INVENTION

This invention is in the field of locks for trunk lids on automobiles, or the like.

Normally, the locks for truck lids on automobiles are key operated and cannot be unlocked in any other way, even though some manufacturers provide a remote control mechanism whereby the trunk lid may be released from within the passenger compartment. It has happened on occasion that children have accidentally locked themselves in trunks and have been unable to get out. Also, there have been instances where persons have been kidnapped and placed in trunk of an automobile where they were held captive. There have been proposals for means whereby a person within a locked automobile trunk could release the latch from inside and without the use of a key. An example of such proposal is in U.S. Pat. No. 3,992,909 but the mechanism shown therein is quite complicated and requires several manipulations including first declutching an inner member from the key lock. Also, the remotely controlled latch arrangements previously referred to might conceivably be manipulated from within the trunk to release the lid but they involve rather complicated mechanisms to be installed by the manufacturer. Examples of such proposals are shown in U.S. Pat. Nos. 3,016,968, 3,062,033, 2,877,038 and 3,985,381. In each of those devices the latch mechanism itself must be modified, at the time of manufacture, to accommodate or provide for the remote control mechanism.

SUMMARY OF THE INVENTION

Most automobile trunk locks in use today comprise the latching mechanism for holding the trunk lid in closed condition and a spaced rotary cylinder lock for actuation by a key. In general, a shaft of sorts connects the rotary cylinder to an element of the latch mechanism to release the same when the tumbler is key activated. The present invention contemplates a simple replacement for that connecting shaft member whereby conventional trunk locking arrangements may be converted to render the same releasable from inside the trunk. In general, the invention comprises such a connecting shaft having a rotary lost motion mechanism whereby the tumbler cylinder may rotate the latch member in one direction to release and where an alternate knob on the inner end of the shaft can be rotated in the same direction, without rotating the tumbler cylinder, to release the latch.

BRIEF DESCRIPTION OF THE DRAWINGS

FIG. 1 is a fragmentary sectional view through a typical trunk lid latching arrangement with the present invention incorporated therein;

FIGS. 2 and 3 are illustrative sectional illustrations, taken on line 2—2 of FIG. 1, of the mechanism of a more or less conventional latch showing the same in locked and unlocked conditions;

DESCRIPTION OF A PREFERED EMBODIMENT

Figure 4:
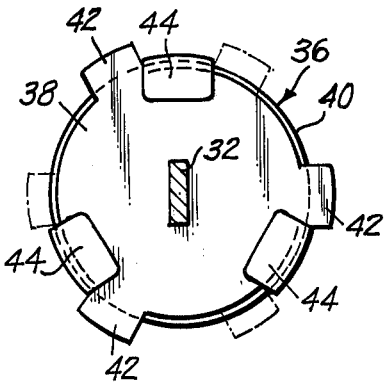
FIG. 4 is an enlarged sectional view taken along the line 4—4 of FIG. 1.

Referring to FIG. 1, numeral 2 indicates the trunk lid of a more or less conventional automobile structure adapted to fit within and close a trunk opening indicated generally at 4. The opening being defined by automobile body structure 6. As shown, a conventional key operated cylinder lock is mounted in the outer panel 3 of the trunk lid 2 and may be removably retained therein by a spring clip 10. A latch mechanism 12 is secured to the inner wall or panel 5 of the trunk lid and cooperates with a keeper pin 14 on the vehicle body for holding the lid in closed position. The latch mechanism 12 is illustrated as being of more or less conventional construction (as shown, for example, in U.S. Pat. No. 3,961,504) having a latching hook 16 (see FIGS. 2 and 3) pivoted therein at 17 for engagement with the keeper pin 14. The latching hook 16 is held in the position illustrated in FIG. 2 by a pawl 18 also pivotally mounted at 19 in the latch housing. A rotatable release cam 20 is provided with a camming portion 22 capable of pivoting the pawl 18 to release latch hook 16 whereupon a spring 24 urges the latch to a position wherein the keeper pin 14 is released. Such mechanisms are basically conventional and need no further description. The release cam 20 is normally provided with a rectangular opening 26 therethrough and a shaft member 28 of rectangular cross section normally extends into the opening 26 and from the latch mechanism extends to the tumbler cylinder. Such shaft mechanism are usually removable and releasably held in driving engagement with the tumbler cylinder by a suitable spring arrangement 30, well known in the art. The other end of the shaft 28 extends freely into the rectangular socket 26 to thereby drivingly connect the key operated lock and the latch mechanism.

According to the present invention a different form of shaft 27 is provided. In conventional constructions, the shaft 28 is a continuous one-piece shaft whereas in the present invention it comprises two sections 32 and 34 joined by a lost motion drive means 36. To convert a conventional lock structure to the present invention it is only necessary to provide a suitable opening in the inner panel or wall 5 of the trunk lid in alignment with the rectangular opening 26 of release cam 20. The shaft of the present invention extends through the release cam 20 and the described opening in the inner wall of the trunk lid and has provided thereon a knob 37. The section 34 of the shaft is provided with a conventional structure for releasably securing the same to the tumbler cylinder and may be of whatever configuration is necessary to cooperate with the particular key operated lock employed.

Figure 5:
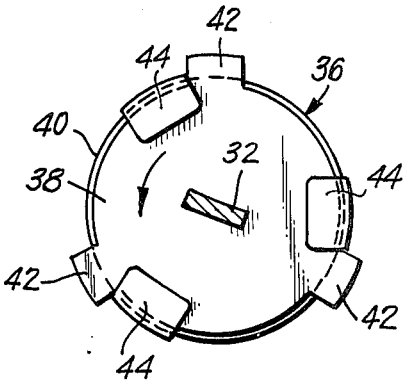
FIG. 5 is a view similar to FIG. 4 but showing the parts in different relative positions.
Figure 6:
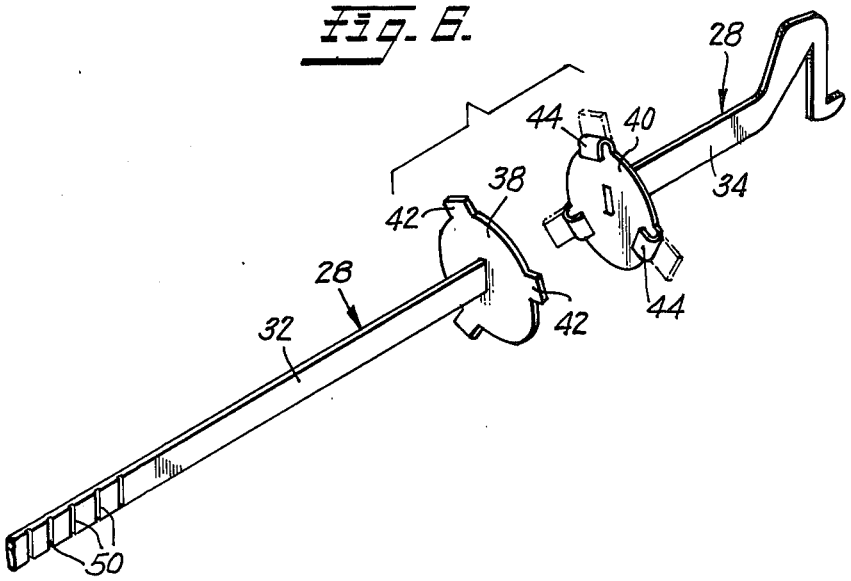
FIG. 6 is an exploded view of the lost motion mechanism to be described.

As shown in FIGS. 4–6, the sections 32 and 34 of the shaft have transverse discs 38 and 40 fixedly secured to their adjacent ends. Each of the discs 38 and 40 is provided with radially outwardly extending lugs or ears 42 and 44. The circumferential spacing between the lugs 42, for example, is greater than the width of the lugs 44. The device is assembled by placing the discs 38 and 40 in face-to-face abutment and bending the lugs 44 into the spaces between lugs 42 and over the peripheral edge of the disc 38 but loosely enough to permit relative rotation between those discs and their respective shaft portions. It will be clear from FIGS. 4 and 5 that the shaft portion 32 can rotate relative to the shaft portion 34 by causing the bent over lugs 44 to slide between adjacent lugs 42. Thus, assuming that the key lock is to be rotated clockwise (as viewed from the outside of the trunk to release the latch, the parts are so positioned that the lugs 44 abut an edge of the lugs 42 when the latch is normally locked, and by clockwise rotation of the tumbler cylinder, the entire shaft is rotated to rotate release cam 20 from the position of FIG. 2 to the position of FIG. 3 wherein the latch is released. As an alternative, a person locked in the vehicle trunk may simply grasp and rotate the knob 37 in a counterclockwise direction, as viewed by him and as shown in FIG. 5, and thus directly release the latch so that the trunk lid can be readily opened from inside.

It is contemplated that the present invention may be offered as a replacement for the conventional shaft structure now present on many or most automobiles. For this reason the shaft portion 32 will be made of sufficient length to fit all trunk structures and will be provided with weakened portions or grooves 50 whereby an appropriate length may be broken off to ensure positioning the knob 37 close to the inner wall of the trunk lid. Preferably, the knob 37 will have a tight frictional fit on the end of the shaft portion 32 so that it may be readily installed.

While a single specific embodiment of the invention has been shown and described herein, the same is merely illustrative of the principles involved and other forms may be resorted to within the scope of the appended claims.

I claim:

1. A latch release device for an automobile having a luggage compartment provided with a movable lid, releasable latch mechanism for holding said lid closed and including a rotary latch release member, a key operated rotary lock spaced from and in generally axial alignment with said latch release member, said key operated lock being accessible from outside said automobile, and a shaft drivingly connecting said key operated lock to said latch release member, the improvement comprising:

said shaft being comprised of a unitary assembly of interconnected and aligned inner and outer portions and rotational lost-motion drive means connecting said portions, said inner portion extending slidably through said latch release member and having a manually actuable knob thereon accessible from the rear side of said latch release member at the interior of said compartment whereby said inner portion of said shaft may be rotated to release said latch without rotating said outer portion and without disconnecting said portions from each other, said outer portion being releasably connected to said key operated lock;

said lost-motion drive means comprising mutually abutting radial discs fixed, respectively, to the adjacent ends of said inner and outer portions of said shaft, each of said discs having lugs extending outwardly from its outer periphery, the circumferential spaces between lugs being greater than the circumferential width of each lug, the lugs of at least one disc being bent over and slidably embracing the peripheral edge portion of the other disc between the lugs thereon.

* * * * *